United States Patent [19]

Moore

[11] Patent Number: 4,784,183

[45] Date of Patent: Nov. 15, 1988

[54] FLUID FLOW DEVICE

[75] Inventor: Alan E. Moore, Newport Pagnell, England

[73] Assignee: The British Hydromechanics Research Association, Cranfield, United Kingdom

[21] Appl. No.: 887,834

[22] PCT Filed: Oct. 22, 1985

[86] PCT No.: PCT/GB85/00486

§ 371 Date: Aug. 11, 1986

§ 102(e) Date: Aug. 11, 1986

[87] PCT Pub. No.: WO86/02578

PCT Pub. Date: May 9, 1986

[30] Foreign Application Priority Data

Oct. 22, 1984 [GB] United Kingdom ..... 8426662

[51] Int. Cl.[4] ..... F15D 1/04

[52] U.S. Cl. ..... 138/39; 138/111; 138/114

[58] Field of Search ..... 138/37, 39, 40, 111, 138/112, 114

[56] References Cited

U.S. PATENT DOCUMENTS 1,946,945 2/1934 Mekler ..... 138/39
4,118,173 10/1978 Shakiba ..... 138/39 X

FOREIGN PATENT DOCUMENTS 151660 3/1962 U.S.S.R. ..... 138/39
442186 2/1936 United Kingdom ..... 138/39

*Primary Examiner*—James E. Bryant, III
*Attorney, Agent, or Firm*—Larson & Taylor

[57] ABSTRACT

A fluid flow device is disclosed wherein fluid flows from an outer conduit to an inner co-axial conduit through a communicating chamber at one end of the conduits. To prevent turbulence in the fluid flow due to the change of axial direction, vanes are provided, some of which extend into the communicating chamber. Some of the vanes may extend continuously from the outer conduit through the communicating chamber to the inner conduit. A flow straightener may also be provided downstream of the vanes in the inner conduit.

6 Claims, 3 Drawing Sheets

FLUID FLOW DEVICE

This invention relates to a fluid flow device having two co-axial conduits and a communicating chamber at one end of both conduits through which fluid may flow from one conduit to the other, reversing its axial direction of flow as it does so.

Such a device is shown in GB-A-1 505 721. Fluid enters the outer conduit at two diametrically opposite locations, so that in flowing down the outer conduit the fluid will possess tangential components of velocity and the axial velocity distribution around the axis of the conduits will not be uniform.

International Publication WO83/03768, deriving from the present applicants, attempts to overcome this problem by inserting vanes within the inner and outer conduits, the vanes extending in axial planes. Although this alleviates the problem, it was found that turbulence was still present within the inner conduit.

The present invention therefore provides a fluid flow device of the type set out above comprising radial vanes parallel to the axis of the conduits within the communicating chamber, extending from the communicating chamber into the inner conduit and from the communicating chamber into the outer conduit. The vanes are preferably continuous throughout the communicating chamber and preferably divide the communicating chamber into separate flow channels.

The fluid flow device preferably comprises means for mounting the conduits so that one axial plane is vertical, and the vanes are preferably arranged symmetrically about this vertical plane. They may also be symmetrically arranged about an axial plane at right angles to this vertical plane.

Figure 1:
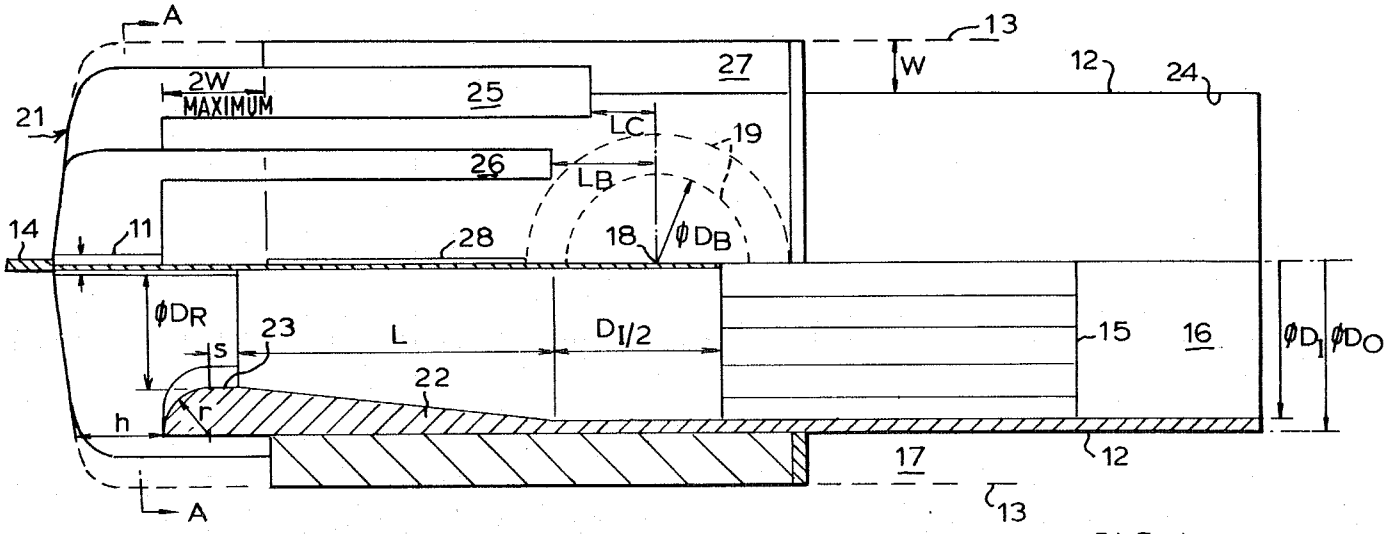
Figure 2:
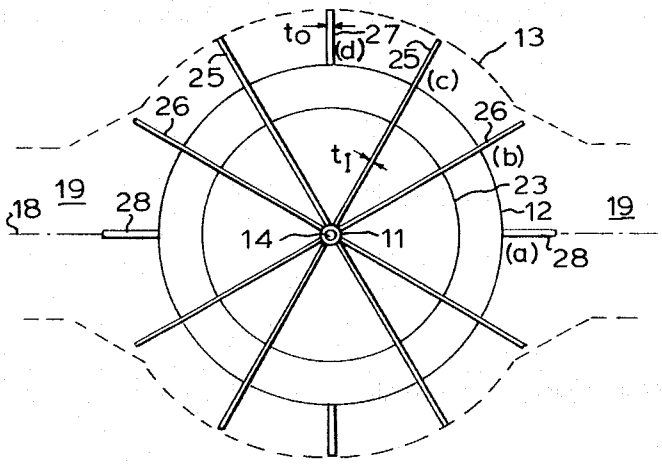
Figure 3:
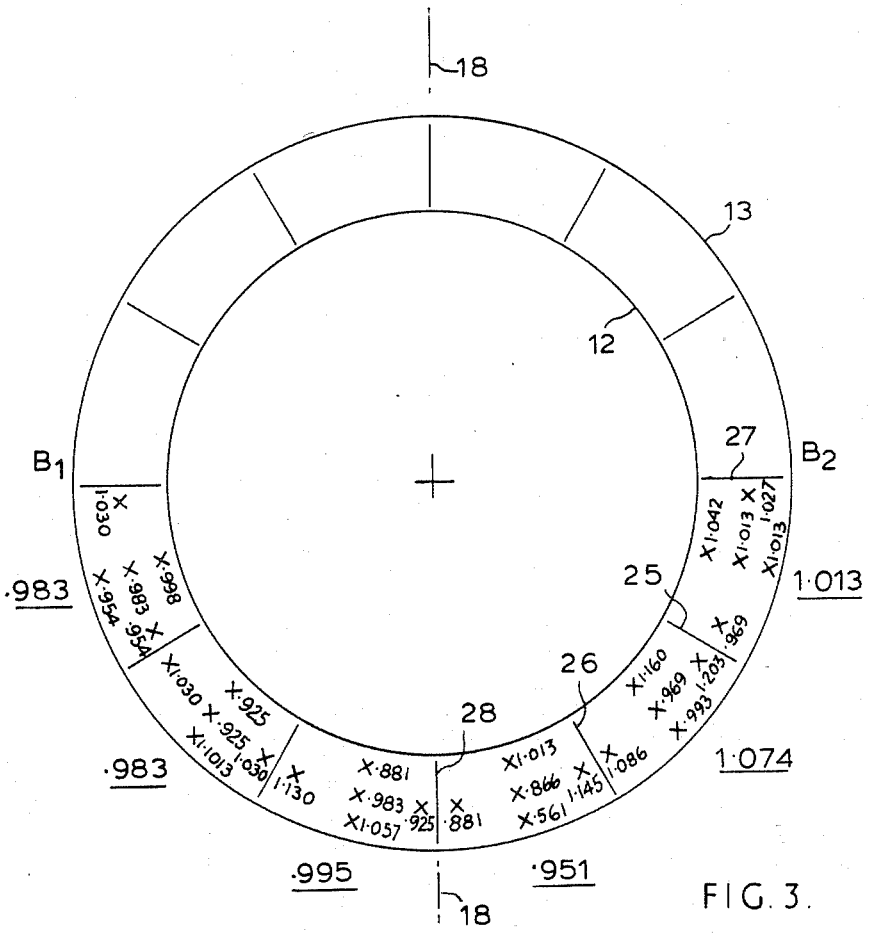
Figure 4B:
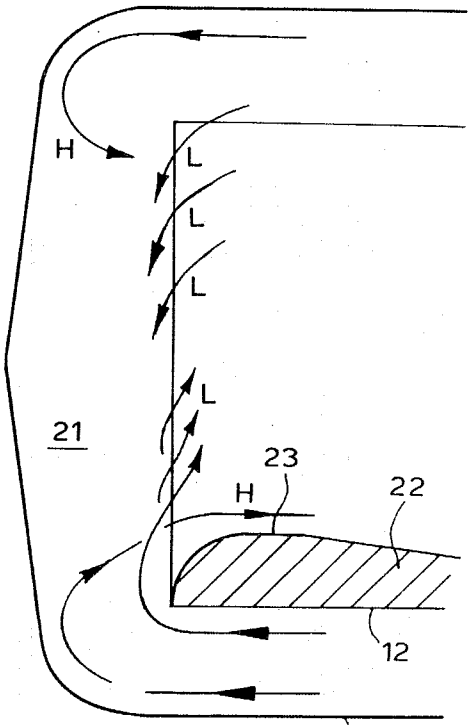
Figure 4A:
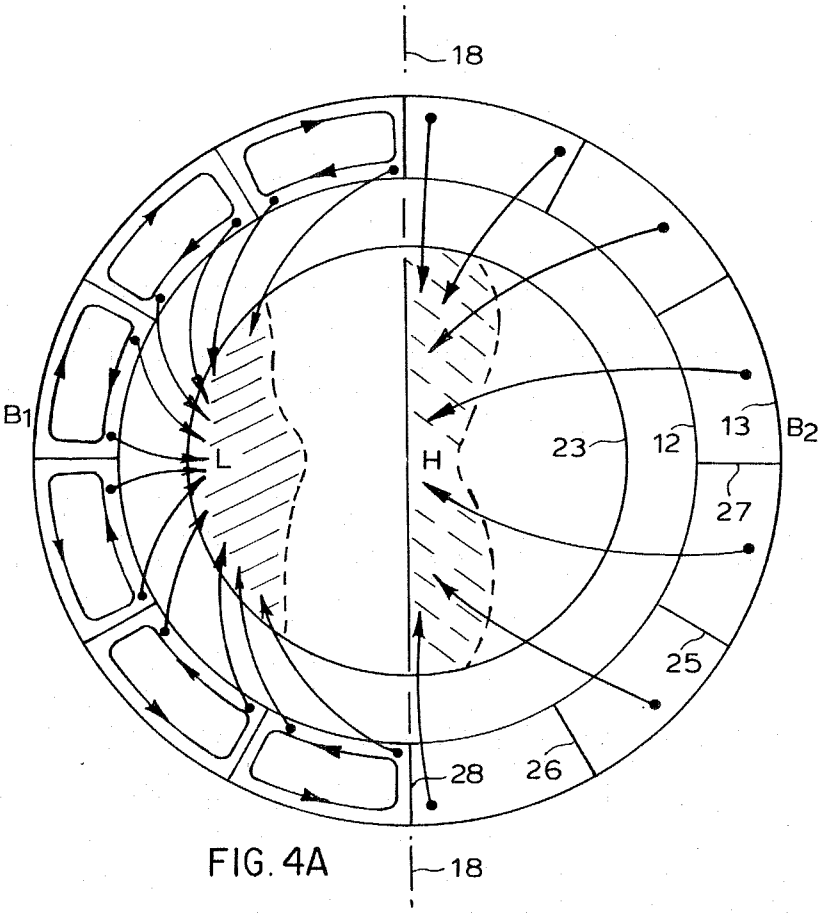

An example of the invention will now be described with reference to the accompanying drawings in which:

FIG. 1 is a part side elevation, part axial section of a fluid flow device with the outer wall of the outer conduit removed, FIG. 2 is a diametral section through the device of FIG. 1 on Lines A—A, FIG. 3 shows a typical velocity squared distribution within the outer channel of the device of FIG. 1, and FIGS. 4A and 4B show the action of secondary flows at the communicating chamber of the device of FIG. 1.

The fluid flow device illustrated in FIGS. 1 and 2 comprises three concentric tubes 11, 12 and 13. The inner tube contains a straightener locating rod 14 connected to a straightener 15 located towards the downstream end of an inner annular channel 16 bounded by the middle conduit 12. This will be described later. An outer annular channel 17 is formed between the middle and outer conduits.

The device is mounted so that the plane represented by FIG. 1 is vertical and the device is movable within this vertical plane by rotation about a horizontal axis 18. Fluid, for example water, enters the outer channel 17 from two diametrically opposite conduits 19 centred on the axis 18 and passes from right to left as seen in FIG. 1 along the outer channel 17 to its left hand end as seen in FIG. 1. The middle conduit 12 ends at a predetermined distance from the end of the outer conduit 13, and within this predetermined distance there is formed a communicating chamber 21 between the inner and outer channels 16 and 17. The outer channel 17 is of constant cross-section between the entry conduit 19 and the communicating chamber 21, but the inner channel 16 is formed with a throat at its left hand end by means of a diffuser 22 whose inner boundary has a quarter-circle portion from the left hand end of the middle conduit 12 to the minimum radius of the throat 23, after which the boundary tapers gently outwardly until it reaches the inner wall of the middle conduit 12, the inner channel 16 thereafter being of constant cross-section except for the straightener 15. A nozzle 24 is located at the downstream end of the inner channel 16, but this is not illustrated in detail.

The purpose of the present apparatus is to provide non-turbulent flow at the nozzle 24 from fluid entering the device at the conduits 19. As can be seen from FIG. 2, the conduits 19 are not uniformly distributed around the common axis of the conduits 11 to 13 and so there will be considerable tangential motion of fluid within the outer channel 17 which will lead to turbulence within the inner channel unless preventive measures are taken. These preventive measures are present in the form of vanes of four different types, 25 to 28. The vanes of each type are symmetrically arranged about the vertical centre line of FIG. 2 and also about its horizontal centre line. The vanes are radial with respect to the common axis of the conduits 11 to 13 and the channel between adjacent vanes subtends an angle of 30° at this axis.

Vanes 26 and 27 are similar. Both vanes extend continuously from a point adjacent the entry conduit 19 through the outer channel 17, the communicating chamber 21 and inner channel 16 to a point downstream of the throat 23. Each vane 25 and 26 forms a continuous and complete barrier between the outer conduit 13 and the mid conduit 12, and between the mid conduit 12 and the inner conduit 11. The vane 26 extends a slightly shorter distance than the vane 25 along the outer channel 17 from the communicating chamber 21 since the conduit 19 extends further along the channel 17 at the position of the vane 26 than the vane 25, and the vanes 25 and 26 are positioned to divide the outer channel 17 into separate longitudinal channels as soon as possible after the fluid leaves the conduit 19.

The two vanes of type 27 lie on the vertical plane through the common axis of the conduits 11 to 13 and extends from the upstream end of the outer channel 17 to a position short of the downstream end of the channel 17 communicating with the chamber 21. The two vanes of type 28 extend from the junction of the conduit 19 with the channel 17 to a downstream boundary level with the downstream boundary of the vanes 27. Thus, vanes of type 27 and 28 do not extend within the communicating chamber 21 or the inner channel 16. The vanes 27 and 28 are thicker than the vanes of type 25 and 26 by a factor of about three.

The straightener 15 comprises a plurality of separate flow channels extending parallel to the common axis of the conduits 11 to 13. These channels may be formed from a plurality of tubes secured together, or from a series of plates extending parallel to the common axis of the conduits and arranged in a grid pattern. The straightener 15 serves to reduce any turbulence which is still present in the inner channel in spite of the effect of the vanes 25 to 28. The thickness of the plates or tube forming the straightener will form a partial blockage of the inner channel 16, and a blockage of less than 20° is acceptable, although a blockage of nearer 10° is preferable. The length of the straightener 15 is about ten times the width of an individual channel within the straightener. The straightener 15 is located at least one fifth of the diameter of conduit 12 from the nozzle and about half the diameter of conduit 12 from the tapering portion of the diffuser 22. Decreasing the size of the individual channels in the straightener 15 increases the blockage ratio since more of the straigtener is taken up by channel walls and was found not to improve turbulence levels, probably because of the increased blockage. Increasing the length of the straightener 15 was found to give less uniform exit velocities whereas shorter lengths decreased the improvement in turbulence levels.

It will be noted that the diffuser 22 varies the size of the inner channel 16, but there is no similar variation of the outer channel 17. The uniform outer channel was found to limit the build-up of retarded fluid within the inner tube, due to the delay in turning the fluid around the bend. The shape of the diffuser 22 was selected to give a ratio of the maximum to minimum cross-sectional area of the inner channel 16 of 1.63. The length of the diffuser 22 was made at the minimum value of 1.3 × the diameter of the throat 23.

It will be seen that there are four each of vanes of type 25 and type 26 and two each of vanes of type 27 and type 28. The vanes of type 25 and 26 prevent any excessive build-up of retarded fluid within the inner tube. The vanes of type 27 and type 28 only extend in the outer channel 17 since they separate flow channels where the secondary flow tends to oppose rather than reinforce adverse build-up of retarded fluid.

In the apparatus shown in FIG. 1, the indicated dimensions are:

$D_B$=303 mm, $D_O$=592.8 mm, $D_I$=552.6 mm,

W=89.6 mm, $L_C$=0.366 $D_B$, $L_b$=0.614 $D_B$,

Maximum thickness of vanes of type 27, $T_O$=0.075 W,

Maximum thickness of vanes of type 25 and 26, $T_I$=0.2 W,

Outer diameter of tube 11, D=0.07 $D_R$, $D_R$ being the diameter of throat 23, Nose radius of vanes type 27,28=0.03 W+14° taper for vane 27 only, Length of communicating channel h=1.55 AA ($\pi D_O$) where AA=cross-sectional area of outer channel 17, Diameter of throat $D_R=\sqrt{0.77AA/\pi}$, Axial extent of minimum radius portion of throat 23, S=0.15 $D_R$, Length of tapered portion of diffuser 22,L=1.3 $D_R$ The figures appearing between the middle and outer conduits 12 and 13 in FIG. 3 represent the square of the ratio of point velocity to mean velocity at points within the outer channel 17 and figures shown outside the outer conduit 13 represent the mean values within the adjacent passageways. These figures were measured with the common axis of the conduits 11 to 13 extending at 35° to the horizontal. The figures towards the top of the device, shown to the right of FIG. 3, are generally higher than those for the bottom, shown to the left.

FIG. 4 shows secondary flows at the communicating chamber 21 with the apparatus in the same orientation as FIG. 3, the arrows H and L representing high and low velocity fluid respectively.

What is claimed is:

1. A fluid flow device comprising two co-axial conduits, a communicating chamber at one end of both conduits through which fluid may flow from one conduit to the other, reversing its axial direction of flow as it does so, vanes within the communicating chamber, each extending in a plane containing the common axis of the conduits and extending from the communicating chamber into the inner conduit and from the communicating chamber into the outer conduit, the planes of adjacent vanes being inclined at angles other than 90 degrees.

2. A device as claimed in claim 1 wherein a said vane extends continuously from the inner conduit to the outer conduit through the communicating chamber.

3. A device as claimed in claim 2 wherein the said vane divides the communicating chamber into separate flow channels.

4. A device as claimed in claim 1 comprising means for mounting said conduits so that one axial plane is vertical.

5. A device as claimed in claim 4 wherein said radial vanes are arranged symmetrically about said vertical plane.

6. A device as claimed in claim 5 wherein said radial vanes are arranged symmetrically about the axial plane at right angles to said vertical plane.

* * * * *